United States Patent [19]

Sandberg

[11] 4,224,892

[45] Sep. 30, 1980

[54] ANCHOR DEVELOPMENT

[76] Inventor: Gunivar Sandberg, P.L. 1155, 28062 Hanaskog, Sweden

[21] Appl. No.: 927,924

[22] Filed: Jul. 25, 1978

[30] Foreign Application Priority Data

Jun. 7, 1978 [CA] Canada ..... 304935

[51] Int. Cl.[3] ..... B63B 21/26

[52] U.S. Cl. ..... 114/294

[58] Field of Search ..... 114/294, 297, 302, 303, 114/311, 298, 306, 299

[56] References Cited

U.S. PATENT DOCUMENTS

| | | | |
|---|---|---|---|
| 1,325,693 | 12/1919 | Deam | 114/303 |
| 2,468,077 | 4/1949 | Kellum | 114/310 X |
| 2,698,592 | 1/1955 | Landwehr | 114/311 |
| 2,956,529 | 10/1960 | Samalion | 114/299 |

FOREIGN PATENT DOCUMENTS

| | | | |
|---|---|---|---|
| 113861 | 3/1918 | United Kingdom | 114/311 |

*Primary Examiner*—Sherman D. Basinger
*Attorney, Agent, or Firm*—Shlesinger, Arkwright, Garvey and Dinsmore

[57] ABSTRACT

An anchor comprises a base member with a pair of side members swingably connected to its adjacent opposite ends. The ends of the side members remote from the mountings are designed to be coupled and connected to a flexible anchor connection. Bottom engaging means project from the anchor in its triangular arrangement. The anchor is designed when the side members are uncoupled so that the side members may be swung into a position where they are side by side with each other and with the base member.

3 Claims, 5 Drawing Figures

ANCHOR DEVELOPMENT

This invention relates to a novel anchor. Conventional forms of anchors are well known. Conventional anchors, however, suffer from the disadvantage that their dimensions in use are substantially the same as their dimensions when stored. Thus the anchor is bulky to transport and to store on a boat.

The inventive anchor, in one aspect of the invention, comprises a base, and two side members swingably connected to the base adjacent each end; the two side members being designed, when the anchor is in use, to be coupled at their ends remote from the base to form an anchor where the two side members and the base form a triangle and having bottom engaging means projecting therefrom. On the other hand, when the anchor is not in use, it is designed so that the triangle may be collapsed and the side members and the base lie side-by side. The anchor is thus easy to transport and store when not in use.

The invention, in another aspect, relates to an anchor of triangular form with attachment for an anchor cable or chain at one apex and having bottom engaging members projecting transversely on each side of the plane of the triangle on or adjacent the base. It is found that the anchor, thus constructed, outperforms many conventional anchors.

Figure 1:
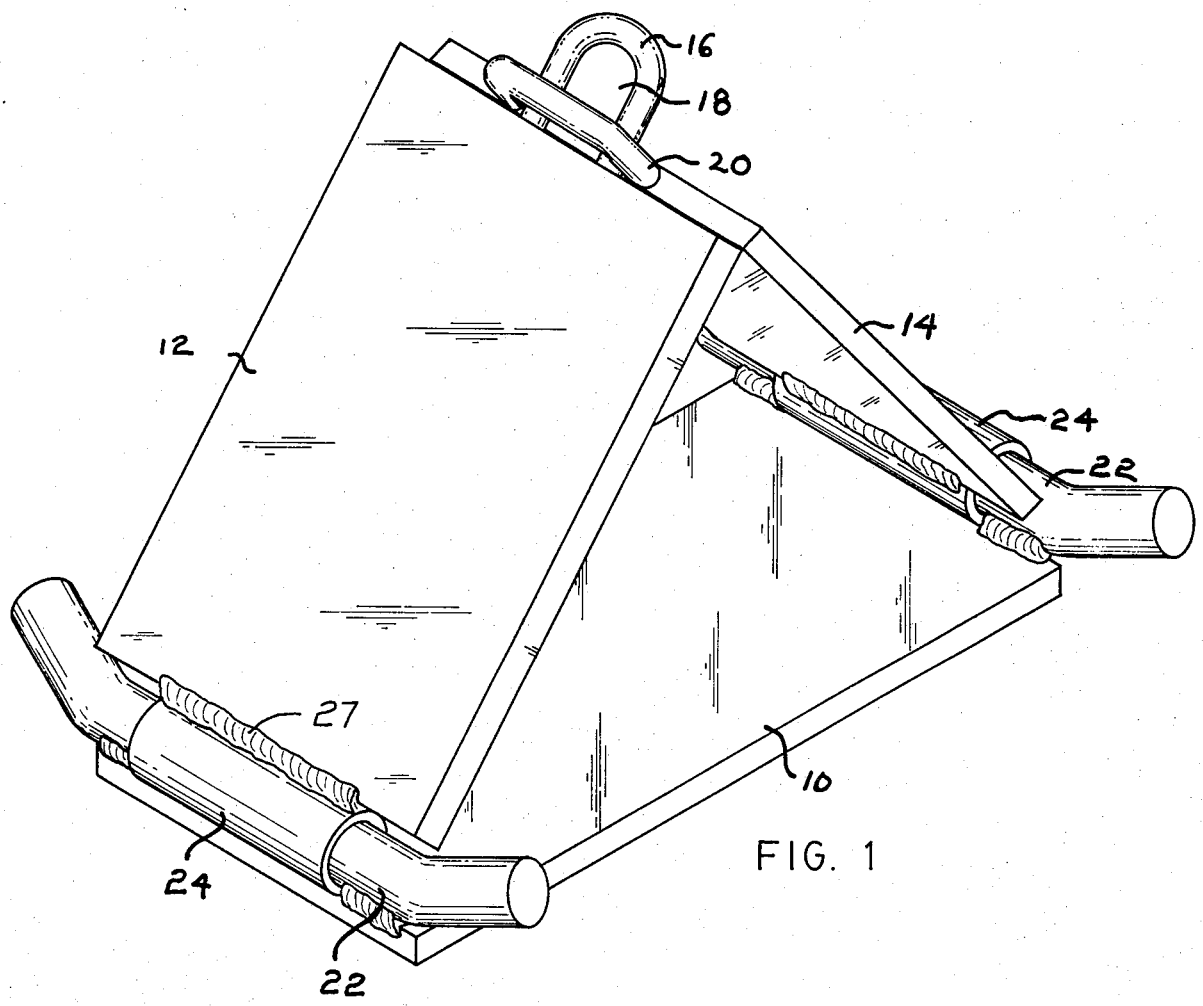
Figure 2:
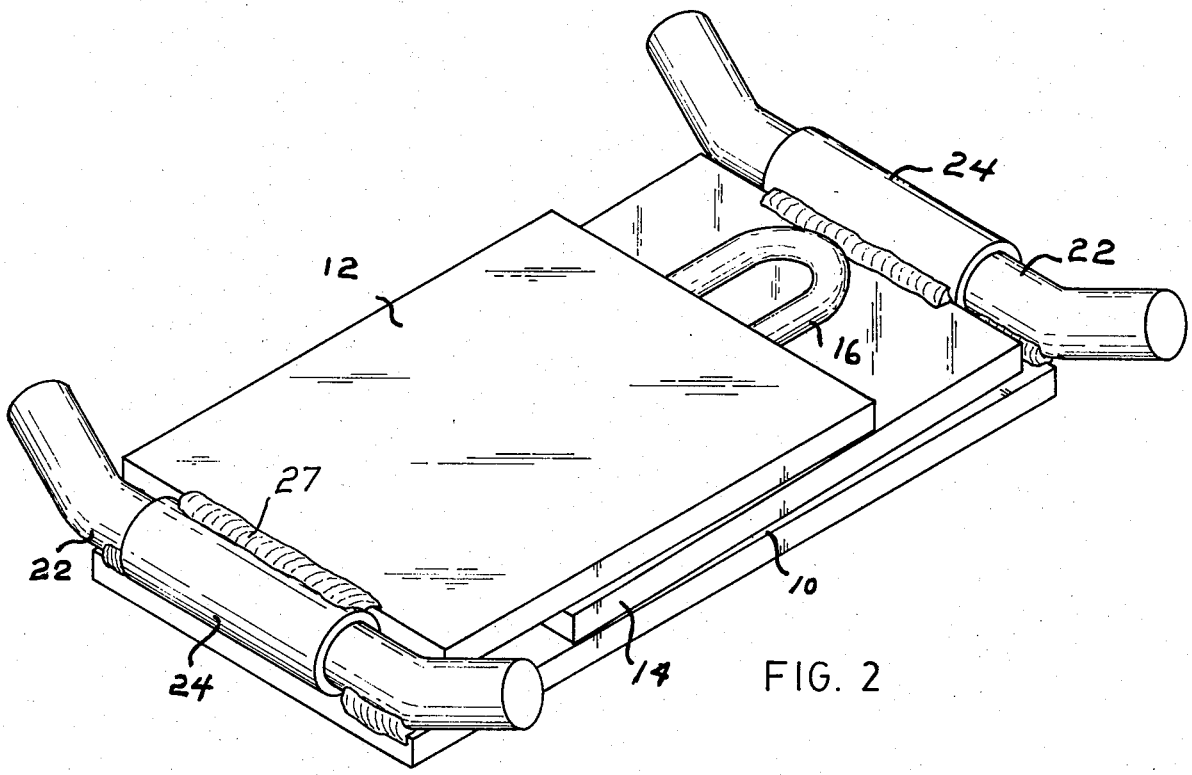
Figure 4:
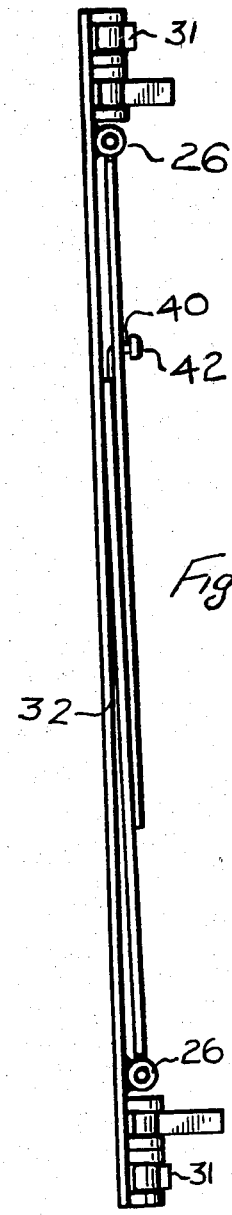
Figure 3:
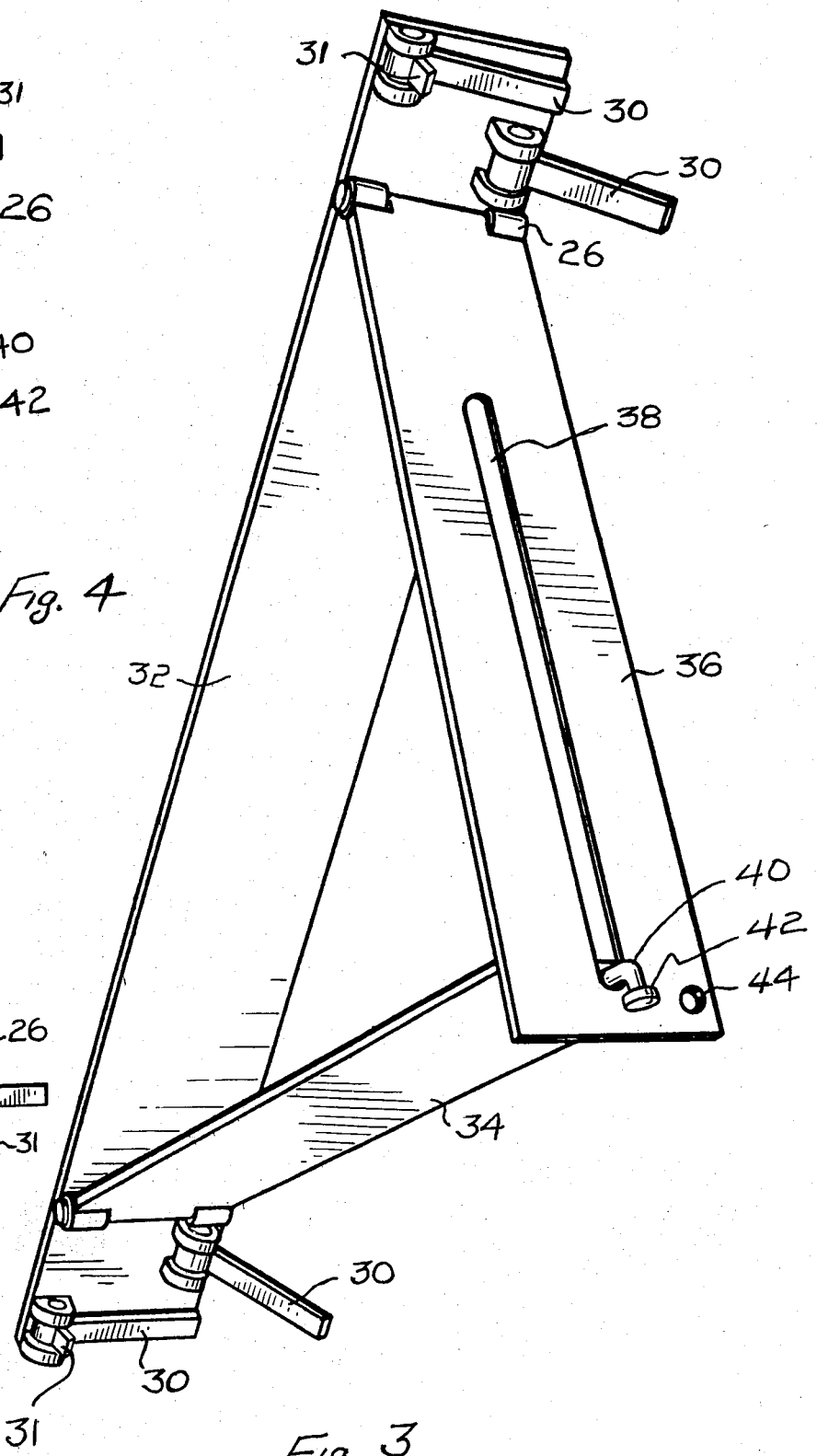
Figure 5:
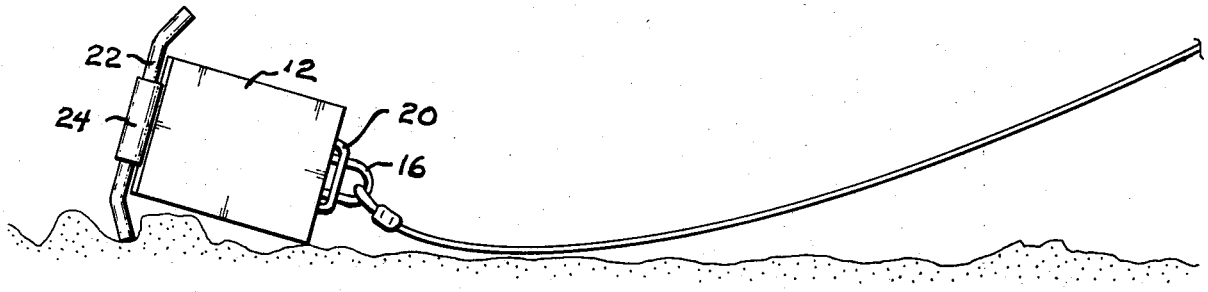

In drawings which illustrate a preferred embodiment of the invention:

FIG. 1 shows an anchor in accord with the invention in erected attitude for use, FIG. 2 shows the anchor in collapsed attitude for storage, FIG. 3 shows an alternative form of the anchor in erected attitude for use; and FIG. 4 shows the anchor of FIG. 3 in collapsed attitude for storage, FIG. 5 shows a drawing of a typical attitude for an anchor in accord with the invention.

In FIG. 1 is shown an anchor made of three flat plates 10, 12 and 14 connected to form a triangle, the long dimensions of the plates corresponding generally to the sides of the triangle and the short dimensions extending transverse to the plane of the triangle. The "plane of the triangle" herein is the plane which would cut the members generally perpendicular to the flat plates at cutting intersections substantially a triangle. Means are provided for coupling the triangle to an anchor cable or chain and, in the embodiment shown, the coupling means comprises a bight 16 rigidly attached to project from the free end of one of the sides 12, and defining an eye 18. The bight 16 is dimensioned to pass through the eye defined in a bight 20 rigidly attached to project from the free end of the other side 14. The bight 16 and eye 18 extending through bight 20 allow attachment of a clasp or clamp from the anchor cable (as indicated in FIG. 5). The base 10 of the triangle opposite the bights 16 and 20 is a flat plate perpendicular to the plane of the triangle. Projecting from the plate on each side, approximately perpendicular to the plane of the triangle, are tines 22, rigidly attached to the plate 10 to engage the bottom (again as indicated in FIG. 5). Preferably the tines 22 are bent between their mounting and their extremities at an angle of about 20°–40° to their central extent in a sense toward the apex of the triangle. The common attitude of the anchor, as shown in FIG. 1, in use, (length of anchor cable about 10×depth) (see FIG. 5) has an average angle for the cable of about 6° and the anchor-adjacent chain or cable lies on the bottom so that the common attitude of the anchor is as shown in FIG. 5. The anchor as shown in FIG. 1 is advantageous with both rocky and sandy bottoms, the tines operating to best advantage on rock and the flat plate 10 to best advantage with sand. The advantages of the invention, so far described, apply equally to the embodiment of FIGS. 3 and 4 as to that of FIGS. 1 and 2.

However in FIGS. 1 and 2 the preferred embodiment shows rigid tines 22, as described, formed of cylindrical steel rod welded to each end of the base member 10. The welded attachment of the rod to the base leaves a central extended slot between rod 22 and base 10. This allows the attachment of the side members 12 or 14 by providing it with a tubular bearing 24 allowing the side members 12 or 14 to pivot relative to the base. Construction of these members is performed by (in sequence), applying the tube 24 formed on the end of a side member over a straight piece of rod of the right length to form a rod 22, then welding the rod to the base at each side thereof (at locations 27 in FIGS. 1 and 2), then bending each projecting end of the rod to form the tine 22, as shown. The rod 24 are welded to be slightly staggered (not shown) in their distance from the base 10, so that when the anchor is not in use the sides 12 and 14 may be folded into side by side relation as shown in FIG. 2. In this attitude the anchor is very compact for storage or transport. When it is desired to use the anchor, the sides 12 and 14 are folded up to triangle position and the thinner bight 16 on one of the side members is slid through the thicker bight 20 on the other of the side member. The extending portion of the thinner bight is used for attachment for an anchor chain to which is in turn attached to an anchor cable.

It will be appreciated that any other means allowing the sides to be coupled in triangle attitude with a cable attachment may be used, which also allows detachment of the side-to-side coupling to collapse the sides into the position of FIG. 2.

FIGS. 3 and 4 illustrate an anchor which is triangular when erected and compact when collapsed but having some alternative facets of the invention to those shown in the embodiment of FIGS. 1 and 2. In the embodiment of FIGS. 3 and 4, the pivots 26 for joining the sides 34 and 36 to the base 32 are separate from the tines. The tines 30 are pivotally mounted on the base and are mounted to rotate under gravity from a retracted position to an extended position on whichever side of the base 32 is downward and the design is arranged preferably with stop means 31 to stop the opening movement of tines 30 when they are projecting at an angle of 20°–40° to the plane of base 32 (similar to the angle of the tine ends of FIGS. 1 and 2) in a sense toward the apex of the triangle to retain the tines 30 extended when the tines 30 strike the bottom. In this aspect the alternative is more compact than that of FIGS. 1 and 2 since the tines may be folded inward but the possibility that the tines 30 of FIG. 3 will foul at their pivots and fail to lower under gravity renders the construction of FIGS. 1 and 2 preferable for many applications.

Another alternative arrangement shown in FIGS. 3 and 4 is the replacing of the bights by an arrangement including a longitudinally extending slot 38 in one of the sides 36 and a shank 40 on the other member projecting through the slot and having a button 42 welded on the outer end of the shank 40 to retain the shank 40 in the slot 38 and the side members thereby connected. The length of the slot 38 and the angle of the shank 40 are designed and arranged, as indicated in FIGS. 3 and 4, to allow the two side members to move through a range of movement between two limiting positions being the collapsed position of FIG. 4 and the triangle position of FIG. 3. The attachment means for the embodiment of FIGS. 3 and 4 is represented by the hole 44 of side 36 by which the shackle of an anchor chain may be attached to the anchor. This arrangement has a great advantage over the embodiment of FIGS. 1 and 2 in emergencies since the anchor chain may be left permanently attached to the anchor even in the collapsed position of FIG. 4. This has an advantage over the construction of FIGS. 1 and 2 in an emergency since the FIGS. 3–4 anchor already attached to the anchor chain may simply be thrown overboard an it will function. By contrast the arrangement of FIGS. 1–2 requires that the anchor chain to be detached when the anchor is collapsed and, in order to use a collapsed anchor, of the FIGS. 1–2 type, it is first necessary to set the anchor to triangular orientation threading one member through another (here one bight through another bight) before attaching the anchor shackle.

The embodiments of the invention in which an exclusive property or privilege is claimed are defined as follows:

1. A collapsible anchor comprising:

a substantially flat base plate, a pair of substantially flat side plates of substantially the same width as said base plate, said side plates being pivotally attached at one end thereof to said base plate at opposite ends of said base plate so that said side plates may pivot from a first position wherein their distal ends form an apex of a triangle opposite said base plate to a second position wherein said side plates are substantially parallel to said base plate and each other and one of said side plates is sandwiched between said base plate and the other of said side plates, means for detachably connecting said side plates as said apex, means for attaching a flexible anchor connection to said anchor adjacent said detachable connection means, and bottom engaging means projecting from said anchor.

2. Anchor as claimed in claim 1 wherein said base plate and said side plates are generally rectilinear substantially flat plates, each plate having its long dimension extending approximately perpendicular to the axis of its respective pivotal connection and the short dimension of said plates extending approximately parallel to such respective pivotal connection.

3. An anchor as claimed in claim 1 wherein said detachable connection means is maintained by the connection of said flexible anchor connection.

* * * * *